United States Patent [19]

Hager, Jr.

[11] Patent Number: 4,563,572

[45] Date of Patent: Jan. 7, 1986

[54] HIGH-EFFICIENCY TASK HEATER

[75] Inventor: Nathaniel E. Hager, Jr., Lancaster, Pa.

[73] Assignee: Armstrong World Industries, Inc., Lancaster, Pa.

[21] Appl. No.: 636,750

[22] Filed: Aug. 1, 1984

[51] Int. Cl.[4] ..... F24H 9/02; H05B 1/00

[52] U.S. Cl. ..... 219/347; 219/349; 219/345; 219/200; 338/280

[58] Field of Search ..... 219/347, 345, 352, 353, 219/354, 349, 200; 338/279, 283

[56] References Cited

U.S. PATENT DOCUMENTS

| | | | |
|---|---|---|---|
| 1,917,461 | 7/1933 | Ronkin | 219/347 |
| 2,512,061 | 6/1950 | Huck | 219/347 X |
| 2,827,539 | 3/1958 | Smith et al. | 219/347 |
| 3,086,187 | 4/1963 | Duggan et al. | 338/283 |
| 3,179,789 | 4/1965 | Gialanella | 219/349 |
| 3,525,850 | 8/1970 | Hager, Jr. | 219/345 X |
| 3,564,200 | 2/1971 | Governale et al. | 219/345 X |
| 3,651,304 | 3/1972 | Fedor | 219/200 |
| 3,786,230 | 1/1974 | Brandenburg, Jr. | 219/345 |
| 3,916,151 | 10/1975 | Reix | 219/345 X |
| 4,011,395 | 3/1977 | Beck | 338/279 X |

*Primary Examiner*—C. L. Albritton
*Assistant Examiner*—M. Lateef

[57] ABSTRACT

The invention is an elongated radiant electrical heater. An elongated parabolic shaped reflector has mounted at its focal point a ribbon heater. A thermal insulation material is mounted on the side of the ribbon heater opposite from the side of the focus where the reflector is positioned. The radiant ribbon heater is deeply corrugated with the height of each corrugation being a multiple of two to three times the width of each corrugation whereby the deep corrugations not only provide mechanical strength, but also increase effective emission per unit area of the radiant heating element.

6 Claims, 3 Drawing Figures

HIGH-EFFICIENCY TASK HEATER

BACKGROUND OF THE INVENTION

The invention is directed to a radiant electric heater and, more specifically, to a corrugated ribbon electrical heater used in conjunction with a parabolic reflector.

DESCRIPTION OF THE PRIOR ART

U.S. Pat. No. 3,525,850, by the same inventor as herein, is directed to a high intensity quick response electrical resistant foil radiant heater. The heater ribbon is corrugated and it is clear from FIG. 1 that the height of a corrugation is about equal to the width of a corrugation.

U.S. Pat. No. 3,600,553 discloses a radiant energy heating apparatus wherein the radiant energy is focused upon discrete zones by a reflector assembly having an elongated configuration with an elliptical cross section. The radiant energy source may be an elongated filament lamp having its longitudinal axis coincident with the primary focus of the reflector. This single reflector assembly has a plurality of reflector sections adapted to cause radiation to be reflected from each of the reflector sections onto separate and discrete areas.

U.S. Pat. No. 1,917,461 discloses an electric heater including the combination of a reflector and a heating element arranged so that no ray will issue from the heater without first impinging against the reflector. In particular, the heating element 13 is carried on a suitable support 14 made of insulating material such that, when mounted in the heater, the heating element faces the reflector while the insulating material points outwardly from the heater. It is noted that the insulating material of this patent is an electrical insulator and not a thermal insulator.

U.S. Pat. No. 2,512,061 is another example of an electric radiating heater which uses a reflector in combination with a heating element so that the heat radiated from the heating element is reflected by the reflector without any direct radiation of heat from the heating element to the area outside the heater.

U.S. Pat. No. 3,179,789 discloses a radiant energy generating and distributing apparatus wherein a radiant energy generator unit is mounted in an elongated reflector 20. A composite coating is formed on the outwardly facing surface of the generator, and this coating consists of an absorbent layer 21 and a reflective layer 22. Thus, the reflective layer tends to receive any heat emanating from the outer surface of the absorbent layer and returns the major portion of the heat to the absorptive layer for reabsorption. This prevents undue loss from convection and conduction.

U.S. Pat. No. 3,786,230 discloses a radiant heater with a panel forming corrugations and having at least one heating element mounted on one of the corrugations. The panels is mounted at a distance from the surface partially defining a space to be heated for permitting fluid circulation between the panel and the space.

U.S. Pat. No. 3,564,200 discloses a heating system employing electromagnetic wave energy propogation to produce heat at the point of absorption of the electromagnetic waves. The system involves a radiator and a reflector. The emitted electromagnetic waves absorbed by remotely disposed objects are converted to heat energy.

Finally, U.S. Pat. No. 2,827,539 is directed to a collimated beam formed from parallel rays. A radiant heating element preferably of generally cylindrical contour is placed adjacent a parabaloid reflector. The surface of the heating element facing the reflector has a convex spherical recess formed therein. The center of the sphere coinciding with the focus of the parabaloid surface. In this manner, the radiant source is a virtual point source so that as the rays emitted from the reflector are parallel.

SUMMARY OF THE INVENTION

The invention is directed to a radiant electric heater comprising an elongated thermal insulating material. Mounted on one surface of the insulating material, there is a corrugated ribbon radiant heated element. An elongated reflector having a parabolic cross section is positioned relative to the heating element. The heating element is positioned at the focus of the parabolic shaped reflector and the thermal insulation is positioned on the side of the focus opposite from the side of the focus where the reflector is positioned. The elongated reflector has an open side from which radiant energy is directed in a fixed pattern. The thermal insulating material is positioned on the side of the radiant heating element which faces the open side of the elongated reflector whereby the thermal insulating material functions to limit heat flow from the side of the radiant heating element facing the open side of the elongated reflector to less than 5% of the total heat flow generated by the radiant heating element. The radiant heating element is deeply corrugated with the height of each of the corrugations being a multiple of two to three times the width of each corrugation whereby the deep corrugations not only provide mechanical strength, but also increase the effective emmissivity per unit area of the radiant heating element, and increase emissions in the directions towards the reflector edges.

DESCRIPTION OF THE PREFERRED EMBODIMENT

Figure 1:
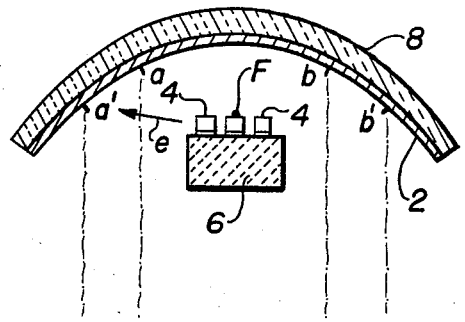
FIG. 1 is a side view of the heating element.

The electric heater is shown in cross section in FIG. 1. A parabolic cross section reflector 2 is utilized. It is approximately four feet long and one foot wide. The focal point/line of the parabolic reflector is aligned along the axis of symmetry of the reflector and the end of the line is shown as point F. The heater runs parallel with the four foot length of the reflector with the center line of the ribbon heater everywhere at the focal distance from the reflector. The ribbon heater is mounted on an insulating material 6. The ribbon heater 4 and insulating material 6 is fully described in U.S. Pat. No. 3,525,850 and the disclosure of that patent is incorporated by reference herein. The only difference between the structure of that patent and the structure herein is that the ribbon of the patent is corrugated with a shallow corrugation such that the height of each corrugation is about equal to the width of each corrugation, and this is shown in FIG. 1 of the patent. In the invention herein the corrugation is of the type shown in FIG. 2 of this application wherein the initial length of the corrugated material would be approximately 120 inches and after it has been corrugated its length is then 40 inches which yields corrugations of a height of 0.156 inches and widths of 0.0625 inches so that the height/width ratio is 2.5. The reflector 2 is a polished aluminum parabolic elongated reflector which faces downward as shown in FIG. 1 and the depth of the reflector is approximately 3.5 inches and its focal point F was determined to be about 2.5 inches below the apex of the parabolic reflector. The back surface of the reflector is painted a flat black and, of course, the surface of the reflector facing the ribbon heater is a polished surface. The unit is operated so as to draw approximately 11.5 amps at 70 volts to provide a maximum power draw of 800 watts. An appropriate controller could be provided to let this wattage output be adjusted to lower power levels. Normally, the unit is suspended 3 to 4 feet above the area to be heated. It should be noted that the insulating material 6 is on the side of the focal point opposite from the side where the reflector is positioned so that the insulating material 6 substantially blocks downward conduction of heat from the ribbon heater and therefore only about 5% of the heat generated by the heating element will be able to pass directly downward. The remaining portion of the heat generated will pass upward to hit the reflector and then be directed downward.

As shown in FIG. 1, there can be used three parallel ribbons, and it is obvious that one or plural ribbons could also be used. It should be noted that the insulating material 6 should have its upper surface sized so that a substantial portion (50–90%) of that surface is covered by active heater ribbon. It is also obvious that the backside of the reflector could be provided with an insulating material such as that shown as element 8.

The unique feature of the ribbon herein is that it is provided with much deeper corrugations than would exist in the prior art devices such as that of U.S. Pat. No. 3,525,850. The corrugations have peaks substantially higher than wide, higher by a factor of 2 or 3. Such corrugations result in as much as a 3 factor reduction in the original ribbon length. It has been shown that as a result of the deep corrugations, it is possible to add to the effective emissivity of the ribbon such that a given area emits 30 to 40% more power at the same ribbon temperature or the same power at a lower temperature with added benefit of longer ribbon life. Should the ribbon be used at a 30 to 40% reduction in power, naturally there would be reduced cost in the cost of wire, switching and controlling devices and at the same time make the system more economical to utilize. The particular ribbon utilized normally is a ribbon such as that shown in FIG. 2. The particular material from which the ribbon is formed is fully disclosed in U.S. Pat. No. 3,525,850. The ribbon 10 of FIG. 2 will have been an initial uncorrugated length of 120 inches and, after corrugation, a length of about 40 inches. The height will be 0.156 inches for the height of a corrugation and the width of a corrugation would be 0.0625 inches giving a height/width ratio of 2.5. A corrugation structure 12 shown in FIG. 3 had an uncorrugated length of 44 inches and the corrugated length would be 40 inches thus providing very mild undulation to the ribbon with the height of the individual corrugation being only a small fraction of the width of a corrugation.

Figure 2:
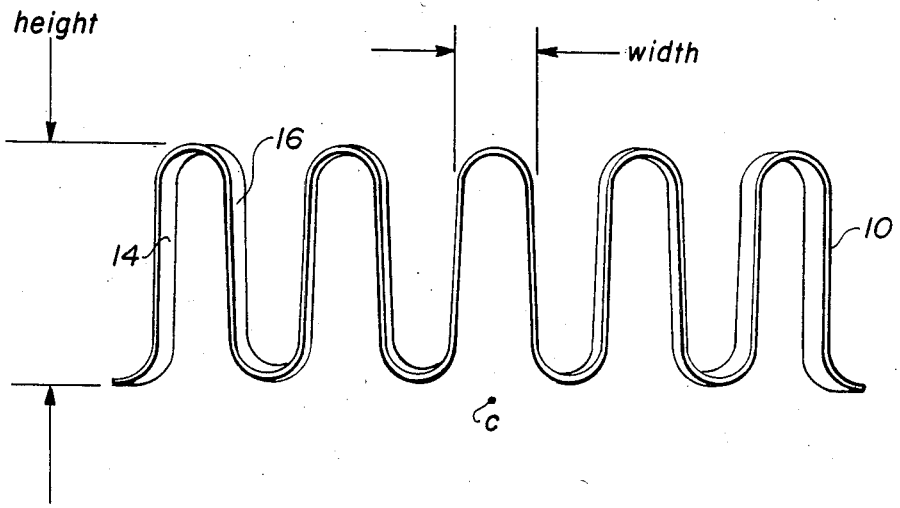
FIG. 2 is a side view of a deeply corrugated ribbon heater.
Figure 3:
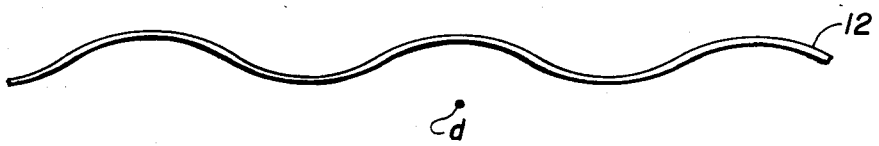
FIG. 3 is a side view of a near flat corrugated ribbon.

Taking the two ribbons shown in FIGS. 2 and 3, the operation of the ribbons was measured. The deeply corrugated ribbon was provided with a nominal current level of about 10.0 amps using 120 volt power supply and the near flat ribbon was provided a nominal level of 14.5 amps using about 55 volts. Both ribbons were operated so that at their steady temperature, as observed by a Leeds and Northrup model 8622 optical pyrometer, were operating at or near 1570° F. The radiometer was placed six inches from the center of the ribbon and was used to measure the radiant flux from each test ribbon. The radiometer consisted of a thin-foil heat-flux sensor (U.S. Pat. No. 3,427,207, issued Feb. 11, 1969) mounted on a 3"×3"×1" aluminum heat sink block. The exposed surface of the sensor was blackened with a flat black enamel. It was estimated that approximately 93% of the radiant flux falling on the surface was absorbed and therefore all but a negligible portion of the radiated energy proceeded through the heat flux sensor to the heat sink block and was therefore measured by the sensor readout system.

Readings of normal radiant heat flux were taken with the principle heat flow direction either being downwardly, upwardly or in a horizontal direction, which meant that the insulating material with the ribbon thereon was either faced with the ribbon downward, the ribbon upward or the ribbon to the sideward direction.

The type of corrugation is indicated as either being the type of deep corrugation above described and so indicated by the letter L or the flat corrugation as indicated by the letter F as shown in FIG. 3. The principle heat flow direction is so indicated and the measured normal radiant heat flux (watts per square inch) is indicated in the third column of the below chart. All temperatures were close to 1570° at the time of reading.

| Type of Corrugation | Principle Heat Direction | Normal Radiant Heat Flux |
|---|---|---|
| L | Down | 1.90 |
| F | Down | 1.40 |
| L | Up | 1.66 |
| F | Up | 1.25 |
| L | Horizontal | 1.76 |
| F | Horizontal | 1.33 |

From the above, it can be seen that the heat flux with the deep corrugations is substantially greater than the heat flux with the nearly flat corrugated ribbon. Consequently, there is noticeably improved heat flux with the deeply corrugated ribbon having a height-width ratio 2.5. Similar tests conducted with a height-width ratio of 1.9 provided heat flux readings of 1.8 when the principle heat flow direction is down, 1.67 with a heat flow direction up and 1.66 with the horizontal heat flow direction. Consequently, when the height of each corrugation is a multiple of two to three times the width of each corrugation there is clearly increased emissivity per unit area of the radiant heating element as indicated by the above heat flux readings.

If one were to view the ribbon of FIG. 3 along a line perpendicular to the plane of the drawing at point d, one would see only the edge of the ribbon. If one were to view the ribbon of FIG. 2 along a line perpendicular to the plane of the drawing at point c, one would see the edge of the ribbon in the region of point c, but when looking to either side of point c, one would see portions of the bottom and top surfaces 14 and 16 of the ribbon.

Naturally, from any viewing position where ribbon area can be seen, that position will receive radiant heat from the ribbon. Therefore, the deeply corrugated ribbion will radiate a greater proportion of its total output towards the edges of the reflector. That is, as shown in FIG. 1, the majority of radiation from a shallow corrugated ribbon would be directed between points a to b of the reflector. With deep corrugated ribbon, the majority of the radiation would be directed between points a' to b' of the reflector. This is due to the increased radiation in the direction of arrow e due to the radiation from surfaces 14 and 16 described above.

What is claimed is:

1. A radiant electric heater comprising:

(a) an elongated thermal insulating material having a thermal conductivity at 1500° F. in the range of about 0.07–0.15 BTU's per hour-foot-degree Fahrenheit;

(b) mounted on one surface of said insulating material there is a corrugated ribbon radiant heating element;

(c) an elongated reflector having a parabolic cross section and being positioned relative to the ribbon heating element without any structural element being positioned therebetween, the heating element being positioned at the focus of the parabolic shape of the reflector and the thermal insulation being positioned on the side of the focus opposite from the side of the focus where the reflector is positioned;

(d) said elongated reflector having an open side from which radiant energy is directed in a fixed pattern;

(e) said thermal insulating material being positioned on the side of the radiant heating element which faces the open side of the elongated reflector whereby the thermal insulating material functions to limit heat flow directly downward from the side of the radiant heating element facing the open side of the elongated reflector to less than 5% of the total heat flow generated by the radiant heating element; and (f) said radiant heating element being deeply corrugated with the height of each corrugation being a multiple of 2 to 3 times the width of each corrugation whereby the deep corrugations not only provide mechanical strength, but also increase effective emissivity per unit area of the radiant heating element.

2. A radiant electric heater as set forth in claim 1 wherein the thermal insulating material has a thermal conductivity at 1500° F. of about 0.11 BTU's per hour-foot-degree Fahrenheit.

3. A radiant electrical heater as set forth in claim 1 wherein said radiant heating element is a ribbon of stainless steel and there may be more than a single ribbon used with plural ribbons placed in a side by side relationship.

4. A radiant electrical heater as set forth in claim 1 wherein the reflector has a polished surface facing the radiant heating element and a blackened surface on the opposite side of the reflector and an insulation material optionally placed on the back of the reflector.

5. A radiant electrical heater as set forth in claim 1 wherein the height of a corrugation is measured from the bottom of one corrugation to the high point of the adjacent corrugation and the width of a corrugation is measured from one side of a corrugation to the opposite side of the same corrugation.

6. A radiant electrical heater as set forth in claim 1 wherein the radiant heating element covers 50% or more of the surface of the thermal insulating material.

* * * * *